US011069330B2

(12) United States Patent
Rabe et al.

(10) Patent No.: US 11,069,330 B2
(45) Date of Patent: Jul. 20, 2021

(54) TONE BAR OF A PERCUSSION INSTRUMENT AND ASSOCIATED CONNECTING ELEMENT

(71) Applicant: SONOR GmbH, Bad Berleburg (DE)

(72) Inventors: Philipp Rabe, Edertal-Wellen (DE); Knut Hoyer, Villingen-Schwenningen (DE)

(73) Assignee: SONOR GmbH, Bad Berleburg (DE)

( * ) Notice: Subject to any disclaimer, the term of this patent is extended or adjusted under 35 U.S.C. 154(b) by 0 days.

(21) Appl. No.: 17/019,592

(22) Filed: Sep. 14, 2020

(65) Prior Publication Data

US 2021/0082378 A1 Mar. 18, 2021

(30) Foreign Application Priority Data

Sep. 16, 2019 (DE) ..... 10 2019 124 890.6

(51) Int. Cl.
*G10D 13/08* (2020.01)

(52) U.S. Cl.
CPC ..... *G10D 13/08* (2013.01)

(58) Field of Classification Search
CPC ..... G10D 13/08; G10D 13/01; G10D 13/024
See application file for complete search history.

(56) References Cited

U.S. PATENT DOCUMENTS 3,174,382 A * 3/1965 Gugelot ..... G10D 13/08 84/404
5,686,679 A 11/1997 Nakano et al.

FOREIGN PATENT DOCUMENTS

| | | | | |
|---|---|---|---|---|
| DE | 7346111 U | | 4/1974 | |
| DE | 1803789 B2 | | 6/1975 | |
| DE | 9108858 U1 | | 10/1991 | |
| DE | 9116075 U1 | | 2/1992 | |
| DE | 19707358 C2 | | 2/2002 | |
| DE | 202005017628 U1 | | 6/2006 | |
| DE | 102013101694 | | 6/2014 | |
| EP | 1872091 A1 | | 1/2008 | |
| GB | 2564438 A | * | 1/2019 | ..... G10G 5/00 |
| NL | 7605085 A | | 11/1977 | |

OTHER PUBLICATIONS

Co-pending U.S. Appl. No. 17/019,496.
Co-pending U.S. Appl. No. 17/247,631.

* cited by examiner

*Primary Examiner* — Kimberly R Lockett
(74) *Attorney, Agent, or Firm* — Smartpat PLC

(57) ABSTRACT

A tone bar of a percussion instrument and an associated connecting element are presented. A percussion instrument having at least one tone bar and at least one connecting element are also presented.

16 Claims, 2 Drawing Sheets

TONE BAR OF A PERCUSSION INSTRUMENT AND ASSOCIATED CONNECTING ELEMENT

TECHNICAL FIELD

The disclosure relates to a tone bar of a percussion instrument and an associated connecting element.

BACKGROUND

Typically, a tone bar is fastened to the body of a percussion instrument with at least one retaining pin. For this purpose, the tone bar is perforated at least once throughout, wherein the hole may be designed as a slotted hole. An associated retaining pin typically has three areas: a first connecting area for fastening to the body of the percussion instrument, a second connecting area for connecting to the tone bar, and a third area for providing a gap between the first two connecting areas.

With a possible structural shape of a retaining pin, the upper end of the second connecting area projects beyond the upper side of the tone bar and may include a thickening that is larger than the width of the slotted hole. The third area also has a larger cross-section. In particular, the cross-section is larger than the width of the slotted hole and larger than a receptacle in the body of the percussion instrument for the first connecting area. The third area then also serves as a support for the tone bar.

Alternatively, retaining pins can be used without a thickening of the second connecting area. This comes with a risk that the tone bars may come loose from the body of the percussion instrument.

If the material of the retaining pin is sufficiently elastic, the tone bar can be fastened in a swinging and detachable manner between the third area and the thickening at the end of the second area. The disadvantage of this design is that each time the tone bar is changed, the thickening at the end of the second connecting element is strongly elastically deformed. This means that if the tone bar is changed multiple times, the thickening will be sheared off slightly and a secure fastening is then no longer guaranteed, or the connecting element will have to be replaced. This is particularly disadvantageous when multiple connecting elements are connected to form a chain. If rigid materials are used for the retaining pins, there is always the risk that they will break out or break off.

With the familiar structural shapes, undesirable differences in the height of the playing surface are avoided when multiple tone bars are used in a percussion instrument through the use of the same tone bar profile for all pitches. The pitch is then determined by the design of the tuning bow of the tone bar. The disadvantage here is that compromises must be made between pitch and tone bar profile. Alternatively, the surface of the percussion instrument can be adjusted to the tone bar profiles of the tone bars. However, this is disadvantageous for production costs. An exchange of whole-tone tone bars for half-tone tone bars is only possible with height differences of the playing surface.

SUMMARY

The object of the disclosure is to further develop a tone bar and an associated fastening element such that a secure fastening is guaranteed even if the tone bar is changed multiple times.

The object is solved with a tone bar and an associated connecting element as claimed. The tone bar has at least one first recess for receiving at least one first connecting area of an associated connecting element on the lower side of the tone bar. This design of the tone bar enables a fastening with the associated connecting element.

An advantageous design is that the first recess of the tone bar does not extend through the upper side of the tone bar. This reduces the manufacturing effort of the tone bar and improves the design quality of the instrument.

Furthermore, it is advantageous that the first recess is a blind hole. This has the advantage that with the usual materials used for the tone bars, such as wood or metal, it is simpler and more cost-effective to make a bore than, for example, a milled slotted hole or a different geometry of the first recess.

It is preferred if the recess has a thread. This, in conjunction with a complementary thread on a surface of an associated connecting element, can create a releasable and secure fastening. Even if the tone bar is changed multiple times, the danger that the first connecting area is sheared off by the significant reduction of the elastic deformation, in the case of the advantageous screw connection, compared to the elastic deformation of a retaining pin when exchanging the tone bar, is minimized.

Furthermore, it is advantageous if the first recess is surrounded by a second recess with a larger cross-sectional area than the first recess. Preferably, the second recess has a smaller depth than the first recess with respect to the lower side of the tone bar. In this manner the penetration depth of the connecting element can be limited by a change in the cross-section of the connecting element, without such area of cross-sectional change projecting beyond the lower side of the tone bar. The round design is also to be preferred, since the production is simpler and more cost-effective for given materials of the tone bar compared to other possible geometries.

A connecting element for detachably connecting a tone bar may be characterized in that a second connecting area of the connecting element is detachably connectable to a projection of a receptacle. A first connecting area of the connecting element is detachably connectable to a tone bar, and the connection between the tone bar and the connecting element is stronger than the connection between the connecting element and the projection of the receptacle. This advantageous design ensures that the properties of the fastening of a tone bar on a body of a percussion instrument, such as holding force, elasticity or the like, can be adjusted independently of the combination of properties of the tone bar and the connecting element.

It is advantageous if the connecting element and the projection of the receptacle belonging to the connecting element has a cross-sectional constriction with a passage, and the connecting element is characterized in that the second connecting area of the connecting element has a cross-sectional area that is less than or equal to a cross-sectional area of a passage of the projection. The end of the second connecting area facing the body of the percussion instrument has a thickening that is larger than the cross-sectional area of the passage of the projection. Also, a length of the second connecting area is greater than or equal to a length of the cross-sectional constriction of the projection of the receptacle. The advantage here is that the tone bar lies on the support of the receptacle in a movable manner, and the connecting element has no mechanical tension.

The second connecting area of the connecting element may be made of a less elastic material than the projection of the receptacle. This means that the elastic deformation required when detaching and fastening the tone bar is not provided by the second connecting element, but by the projection of the receptacle. An advantage here is that the durability is higher due to the larger material cross-sections of the projection of the receptacle compared to the connecting element.

Depending on the desired property of the connection between the tone bar and the connecting element, it may be advantageous to make a force-fitting connection by means of at least one groove on the surface of the first connecting area. Among other things, the number, type and depth of the groove must be adjusted, taking into account the mechanical properties of the connecting element material and the desired retention force. Alternatively, a thread can be applied to this surface. This is particularly advantageous if a complementary thread is inserted in the first recess of the tone bar. Depending on commercial parameters, such designs can be substituted among each other, even partially.

The first connecting area advantageously has a round cross-section with different diameters. This means that the connecting element can also be used, in an advantageous manner, for tone bars with different highs or lows, as the case may be, in the first recess of the tone bar. In addition, different tone bar profiles and the associated height differences in the playing surface can be advantageously compensated for.

It is particularly advantageous if the at least one connecting element belonging to a tone bar and the tone bar belonging to it are molded as one integral component. In this design, the first recess of the tone bar and the first connecting area of the associated connecting element no longer need to be produced. In addition, the firmly bonded connection between the connecting element and the tone bar ensures that the tone bar can always be detached from the projection of the receptacle, but the tone bar does not detach from the connecting element. Injection molding is an advantageous molding process for tone bars. In such a case, the tone bar is no longer detachable from the connecting element but enables the two components to be manufactured at a particularly low cost. With tone bars that cannot be molded, such as those made of wood, such embodiment cannot be realized.

A further aspect of the disclosure is that a tone bar has at least one connecting element and that the tone bar and the at least one connecting element are molded as one integral component. This enables the production of particularly inexpensive tone bars.

A percussion instrument may be characterized in that the percussion instrument has at least one tone bar as described and that the percussion instrument has at least one connecting element as described.

DETAILED DESCRIPTION

The invention is described in detail below with reference to the specified figures in the form of exemplary embodiments. In all figures, the same technical elements are marked with the same reference signs.

Figure 1:
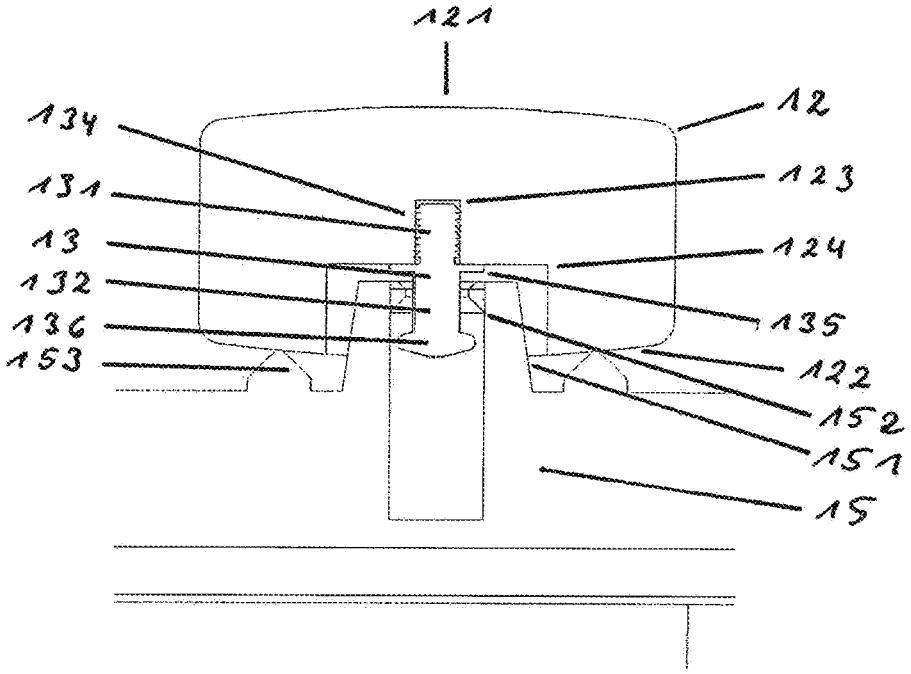
FIG. 1 is a sectional drawing of a tone bar and associated connecting element.

FIG. 1 shows a sectional view of a tone bar 12, a connecting element 13 and an associated receptacle 15 with a projection 151. The receptacle 15 is part of a fastening band consisting of multiple interconnected receptacles. The tone bar 12 has a first recess 123 and a second recess 124. The first connecting area 131 of the connecting element 13 is inserted in the first recess 123. On the surface of the first connecting area 131, there are multiple circumferential grooves. Due to the elastic deformation of the remaining ridges, the first connecting area 131 is held in the first recess in a force-fitting manner.

A cross-sectional enlargement 135 below the grooved surface area limits the penetration depth.

The second connecting area 132 is located in the projection 151 of the receptacle 15 and has a thickening 136 at its lower end. Such thickening 136 is larger than the cross-sectional constriction 152 of the projection 151 of receptacle 15. Given that the gap between the first connecting area 123 and the thickening 136 at the end of the second connecting area 124 is selected to be sufficiently large, the tone bar 12 rests loosely on the supports 153 of the receptacle 15. Furthermore, the cross-section of the second recess 124 is sufficiently large that the thickening 136 can be pulled out of the projection 151, without pressing the projection 151 against the inner side of the second recess 124.

Figure 2A:
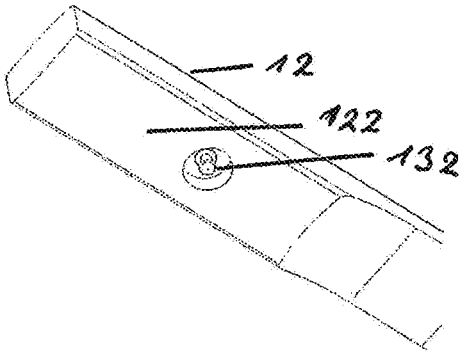
FIG. 2*a* shows a lower side of a tone bar with separate connecting element.

FIG. 2*a* shows the lower side 122 of a tone bar 12. In this exemplary case, the tone bar 12 can be connected to receptacle 15 at one point. At that one point, the connecting element 13 can be inserted into the first round recess 123.

Figure 2B:
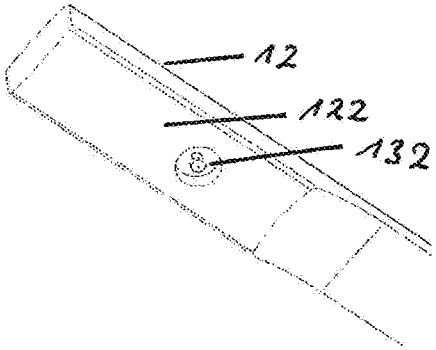
FIG. 2*b* shows a tone bar and connecting element molded as one component.

FIG. 2*b* shows the lower side 122 of a tone bar 12, wherein the tone bar 12 and the associated connecting element have been molded as one component.

Figure 3:
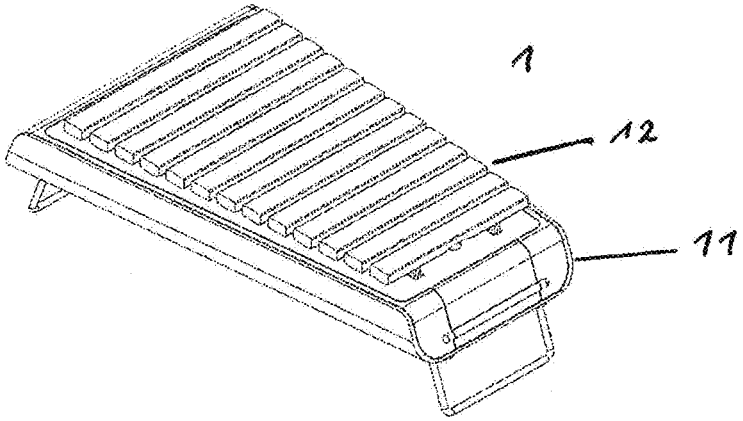
FIG. 3 shows a percussion instrument.

FIG. 3 shows a percussion instrument 1. Multiple tone bars 12 without a pierced surface are connected to the body 11 of the percussion instrument 1.

REFERENCE NUMERALS

1 Percussion instrument
11 Body of the percussion instrument
12 Tone bar
121 Upper side
122 Lower side
123 First recess
124 Second recess
13 Connecting element
131 First connecting area
132 Second connecting area
134 Grooves
135 Limiting piece
136 Thickening
15 Receptacle
151 Projection
152 Cross-sectional constriction of the projection
153 Support

What is claimed is:

1. A tone bar assembly for a percussion instrument, comprising:

a tone bar having an upper side (121) and a lower side (122); and a connecting element (13) for detachably connecting the tone bar (12) to a receptacle (15) of a body (11) of the percussion instrument, wherein the tone bar (12) has a first recess (123) for receiving a first connecting area (131) of the connecting element (13) on the lower side (122) of the tone bar (12), and wherein the first recess of the tone bar does not extend through the upper side of the tone bar.

2. The tone bar assembly as in claim 1, wherein the receptacle (15) is detachably connected to the body (11) and wherein the body (14) of the percussion instrument has connection points on its surface for mechanical fastening of the receptacle (15).

3. The tone bar assembly as in claim 1, wherein the first recess (123) is a blind hole.

4. The tone bar assembly as in claim 3, wherein the blind hole has a thread.

5. The tone bar assembly as in claim 1, wherein the first recess (123) is surrounded by a second recess (124) having a larger cross-sectional area than the first recess (123); and wherein the cross-sectional area of the second recess (124) is larger than a cross-sectional area of a projection (151) of the receptacle (15); and wherein the second recess (124) has a smaller depth than the first recess (123) relative to the lower side (122) of the tone bar (12); and wherein a height of the projection (151) of the receptacle (15) and the depth of the second recess (124) are matched to each other such that the tone bar (12) has no contact with the projection (151) of the receptacle (15).

6. The tone bar assembly as in claim 5, wherein the second recess (124) is round.

7. The tone bar assembly as in claim 1, wherein the connecting element comprises a projection (151) for a second connecting area (132) of the connecting element (13), and wherein the receptacle (15) is located on and/or is detachably connected to the body (11) of the percussion instrument, and wherein the receptacle (15) has a support (153) for the tone bar (12) and wherein multiple receptacles (15) can be connected to form a fastening band, and wherein the second connecting area (132) of the connecting element (13) is detachably connectable to the projection (151) of the receptacle (15), and wherein a first connecting area (131) of the connecting element (13) is detachably connectable to the tone bar (12); and wherein the connection between the tone bar (12) and the connecting element (13) is stronger than the connection between the connecting element (13) and the projection (151) of the receptacle (15).

8. The tone bar assembly as in claim 7, wherein the projection (151) of the receptacle (15) has a cross-sectional constriction (152) with a passage, and wherein the second connecting area (132) of the connecting element (13) has a cross-sectional area that is smaller than or equal to the cross-sectional area of the passage in the cross-sectional constriction (152) of the projection (151), and wherein an end of the second connecting area (132) facing the body (11) of the percussion instrument (1) has a thickening (136) that is larger than the passage in the cross-sectional constriction (152) of the projection (151), and wherein a length of the second connecting area (132) is greater than or equal to a length of the cross-sectional constriction (152) of the projection (151) of the receptacle (15) and thereby the tone bar (12) can rest on the support (153) of the receptacle (15) in a movable manner.

9. The tone bar assembly as in claim 7, wherein the second connecting area (132) of the connecting element (13) is less elastic than the projection (151) of the receptacle (15).

10. The tone bar assembly as in claim 7, wherein the first connecting area (131) comprises at least one groove.

11. The tone bar assembly as in claim 7, wherein the first connecting area (131) comprises a thread.

12. The tone bar assembly as in claim 10, wherein the first connecting area (131) comprises a cross-sectional enlargement.

13. The tone bar assembly as in claim 8, wherein the connecting element (13) has a round cross-section with different diameters.

14. The tone bar assembly as in claim 7, wherein the connecting element (13) and the tone bar (12) molded as one integral component.

15. A tone bar, comprising at least one connecting element (13), wherein the tone bar and the at least one connecting element (13) are molded as one integral component.

16. A percussion instrument, comprising the tone bar assembly according to claim 1.

* * * * *